US006317982B1

(12) United States Patent
Andrew

(10) Patent No.: US 6,317,982 B1
(45) Date of Patent: Nov. 20, 2001

(54) SHAVING SYSTEM AND ADJUSTABLE TRIMMERS THEREFOR

(75) Inventor: Michael A. Andrew, Milford, CT (US)

(73) Assignee: Remington Corporation L.L.C., Bridgeport, CT (US)

( * ) Notice: Subject to any disclaimer, the term of this patent is extended or adjusted under 35 U.S.C. 154(b) by 0 days.

(21) Appl. No.: 09/422,771

(22) Filed: Oct. 22, 1999

(51) Int. Cl.[7] ..... B26B 19/14
(52) U.S. Cl. ..... 30/34.1; 30/43.92
(58) Field of Search ..... 30/34.1, 43.1, 30/43.9, 43.92

(56) References Cited

U.S. PATENT DOCUMENTS 4,274,199 * 6/1981 Gallanis et al. ..... 30/34.1
4,711,028 * 12/1987 Bergsma et al. ..... 30/43.6

* cited by examiner

*Primary Examiner*—Douglas D. Watts
(74) *Attorney, Agent, or Firm*—Melvin I. Stoltz

(57) ABSTRACT

By providing a shaving system having at least one separate and independent hair trimming assembly employed in direct association with an apertured foil or mesh screen cutting assembly in a manner enabling the hair trimming assembly to be movable into a plurality of alternate positions by a single control element for being employed simultaneously with the apertured foil cutting assemblies, a unique shaving system is achieved for cutting both short hair and long hair. Furthermore, in order to accommodate the typical variety of conditions experienced by most users of an electric dry shaving system, whether the system is being employed by men or women, it has been found that the hair trimming assemblies are preferably able to be placed in at least three alternate positions quickly and easily by the simple movement of a single button or switch. In this way, the varying contours of an individual skin surface are easily accommodated and a smooth, comfortable, close shave is realized.

23 Claims, 9 Drawing Sheets

SHAVING SYSTEM AND ADJUSTABLE TRIMMERS THEREFOR

TECHNICAL FIELD

This invention relates to electric dry shavers and, more particularly, to improved long hair and short hair cutting systems for shavers.

BACKGROUND ART

Over the last several years, both men and women have been increasingly drawn to the advantages provided by electric dry shavers. In general, the consuming public has found that the use of razors or other systems is extremely inconvenient for removing or shaving long hair and/or short hair or stubble, as commonly found in men's beards and women's legs. In addition, with the ever increasing time constraints and commitments individuals typically encounter, a fast and effective shaving system is most desirable.

The discomfort as well as the time consumed in using shaving creams, soaps and gels, in order to provide a medium for which a razor can be used, requires more time and inconvenience than most individuals are willing or capable of experiencing. Furthermore, the cost of maintaining a sufficient supply of these products creates an additional burden. Consequently, electric dry shavers have become increasingly popular, as well as battery-operated electric dry shavers which can withstand exposure to moisture, thereby enabling individuals to simultaneously shower, as well as shaving their beard or legs.

As the popularity of using electric dry shavers increased, numerous product designs with alternate constructions proliferated, in an attempt to improve and enhance the comfort and cutting efficiency of such shavers. However, in spite of these products, difficulties have continued to exist in providing optimum results with optimum comfort.

One particular shaver construction has been found to be extremely efficacious in achieving high-quality shaving results, as well as being extremely comfortable to use. This configuration comprises the various models of electric dry shavers incorporating a movable cutting blade which cooperates with a thin, flexible mesh screen or apertured foil.

In operation, the cutting blades are rapidly and continuously reciprocally moved past one side of the mesh screen or apertured foil, causing the cutting blades to repeatedly cross the plurality of apertures and provide a virtually continuous cutting action at each aperture. Then, by slidingly guiding the other side of the mesh screen or apertured foil over the skin surface to be shaved, the individual hair shafts enter the holes formed in the screen or foil and are cut by the movement of the cutting blades.

Although this dry shaving cutting system has proven to be extremely effective, as compared to other dry shaving products, one important area of difficulty does exist. This area of difficulty is found in the shaving of longer hair fibers, typically encountered on necks and women's legs.

In many instances where the longer hair shafts are encountered, the movement of the mesh screen or apertured foil over the skin surface causes the hair fibers to bend, preventing the terminating end of the hair from entering the mesh screen or apertured foil. As a result, these longer hair fibers are not cut and remain on the skin surface.

In an attempt to eliminate this prior art deficiency, many prior art electric dry shavers incorporate separate hair trimming assemblies which are independently formed on the shaver for being separately activated when necessary. Typically, these hair trimmers have a single OFF position and a single ON position, which enables them to be used separately in specific, limited circumstances. However, these prior art shaver systems are incapable of satisfying the need for having the long hair trimmers actively employed as an integral part of the shaving process.

Although some prior art products have attempted to incorporate trimmers in combination with the cutting foils for being used simultaneously with the shaving action provided by the apertured foil or mesh screen, these systems also suffer from an inability of being usable in all shaving circumstances encountered by the individual. Typically, these trimmers are not movable and are only usable in combination with the apertured foil. Consequently, these prior art systems failed to provide the versatility sought by consumers in an electric dry shaving apparatus.

A further problem found in prior art shavers is the inability of the trimmer to move in a "floating" manner when passed over the skin surface. As a result, an uncomfortable shave is produced after causing unwanted cuts.

Consequently, it is a principal object of the present invention to provide an enhanced electric dry shaver system for use by both men and women for effectively cutting both short hair and long hair in virtually all circumstances encountered by the user.

Another object of the present invention is to provide an enhanced electric dry shaving system having the characteristic features described above which is capable of providing a trimmer having a variety of alternate positions, thereby enabling the trimmer to be employed with an apertured foil cutting system regardless of the operation being performed by the aperture foil.

A further object of the present invention is to provide an enhanced electric dry shaving system having the characteristic features described above which enables the trimmer to be quickly and easily selectively positioned and maintained in any of its alternate positions.

Another object of the present invention is to provide an enhanced electric dry shaving system having the characteristic features described above which provides a shaver capable of being vertically flexed or moved during use, thereby achieving a floating action for enhanced comfort.

Other and more specific objects will in part the obvious and will in part appear hereinafter.

SUMMARY OF THE INVENTION

By employing the present invention, all of the prior art difficulties and drawbacks have been completely eliminated and a substantially improved, close and comfortable shaving system is attained which effectively cuts both short hair and long hair. Furthermore, by employing the present invention, a plurality of different shaving conditions are capable of being easily accommodated, thereby providing the user with a shaving system specifically designed for enabling a wide range of shaving conditions to be easily and effectively handled.

In accordance with the present invention, two separate and independent hair trimmers or trimming assemblies are incorporated into the shaver system in direct association with the apertured foil or mesh screen cutting assembly in a manner which enables the hair trimming assemblies is to be employed simultaneously with the apertured foil cutting assemblies whenever desired by the user. In addition, in order to provide added flexibility and multi-purpose functionality, each of the hair trimming assemblies are controllably movable into a variety of alternate positions. In order to assure ease of operation and control, a single movable switch element is employed for simultaneously altering the position of the two trimmer assemblies, placing the trimmer assemblies in the precisely desired orientation or location.

In order to accommodate the typical variety of conditions experienced by most users of an electric dry shaving system, whether the system is being employed by men or women, it has been found that the hair trimming assemblies are preferably able to be placed in at least three alternate positions. In the first desired position, both hair trimming assemblies are maintained below the top surface of the mesh screen or apertured foil. In this position, both hair trimming assemblies are maintained in a position which enables the apertured foil or mesh screen to provide the desired cutting action, with the hair trimming assemblies being positioned in a manner which will not interfere or in any way impede the cutting operation of the apertured foil.

In the second desirable position, both hair trimming assemblies are aligned with the upper, arcuately curved, top surface of the apertured foil or mesh screen for enabling the hair trimming assemblies to be simultaneously employed with the apertured foil cutting assembly. In this way, both long hair and short hair are capable of being cut simultaneously as the shaver system is passed over any particular area to be shaved.

This construction is particularly useful by women when shaving their legs, which frequently require shaving of both long hair and short hair in the same area. Furthermore, the simultaneous activation of the hair trimming assemblies with the apertured foil cutting assembly enables longer hair to be cut partially by the trimmer, with the remaining shorter hair being cut completely by the apertured foil cutting assembly. In this way, substantially improved results are attained.

In a typical third position, one trimmer assembly is desired with the cutting surface thereof raised above the arcuately curved upper surface of the apertured foil cutting assembly, enabling the user to trim long hair fibers separately, without using the cutting action of the apertured foil. In this instance, the second trimmer assembly, as is contemplated by the preferred embodiment of the present invention, is preferably in an inoperative or stowed position, with its cutting edges in a plane below the cutting surface of the top, arcuately curved surfaces of the apertured foil.

In accordance with the present invention, each of these three desired positions are quickly and easily achieved by the simple movement of a single button or switch. In accordance with this invention, the single button or switch is connected directly to an activation band which is interconnected with both independent trimmer assemblies for producing the simultaneous movement of the trimmer assemblies by the movement of the single switch.

In addition, separate cam control elements are affixed to the activation band and the cam control elements are mounted in association with each trimmer assembly. In this way, the movement of the single switch also causes the cam control elements to be simultaneously moved therewith, controlling the position of each trimmer assembly in a single, one step, easily achieved operation. In this way, the single switch is capable of quickly and easily moving the two separate and independent trimmer assemblies between all of their alternate positions.

As mentioned above, an additional difficulty encountered with prior art trimmer assemblies is the rigidness inherent in virtually all constructions. As a result, once a trimmer assembly is placed in an operative position, the cutting action is activated. However, no vertical movement or vertical adjustability is capable of being provided by the prior art trimmer assemblies. As a result, substantial discomfort during the shaving operation is frequently encountered as the trimmer passes over the contours found on the user's skin surface.

In order to overcome this prior art shortcoming, the trimmer assemblies of the present invention are preferably constructed in a manner which enable each trimmer assembly to be longitudinally movable in its normal plane of operation. In this way, a rigid operational position is eliminated and a substantial degree of flexibility and axial deflection is provided. By employing the present invention, the trimmer assembly is flexibly or longitudinally movable along with the contours of the skin surface over which the trimmer is moved. As a result, the varying contours of an individual skill surface are easily accommodated and a smooth, comfortable, close shave is realized.

The invention accordingly comprises the features of construction, combinations of elements and arrangement of parts which will be exemplified in the constructions hereinafter set forth, and the scope of the invention will be indicated in the claims.

THE DRAWINGS

For a fuller understanding of the nature and objects of the invention, reference should be had to the following detailed description taken in connection with the accompanying drawings, in which.

DETAILED DISCLOSURE

By referring to FIGS. 1–16, along with the following detailed discussion, the construction and operation of the preferred embodiment of the shaver system of the present invention can best be understood, providing a complete detailed disclosure of the best mode for carrying out the present invention. However, as will be apparent to one of ordinary skill in this art, the present invention may be implemented in a wide variety of alternate constructions and configurations. Consequently, it is intended that the embodiment depicted in FIGS. 1–16 and detailed herein shall be considered as an example of the present invention and not as a limitation of the scope of protection afforded by this disclosure.

Figure 1:
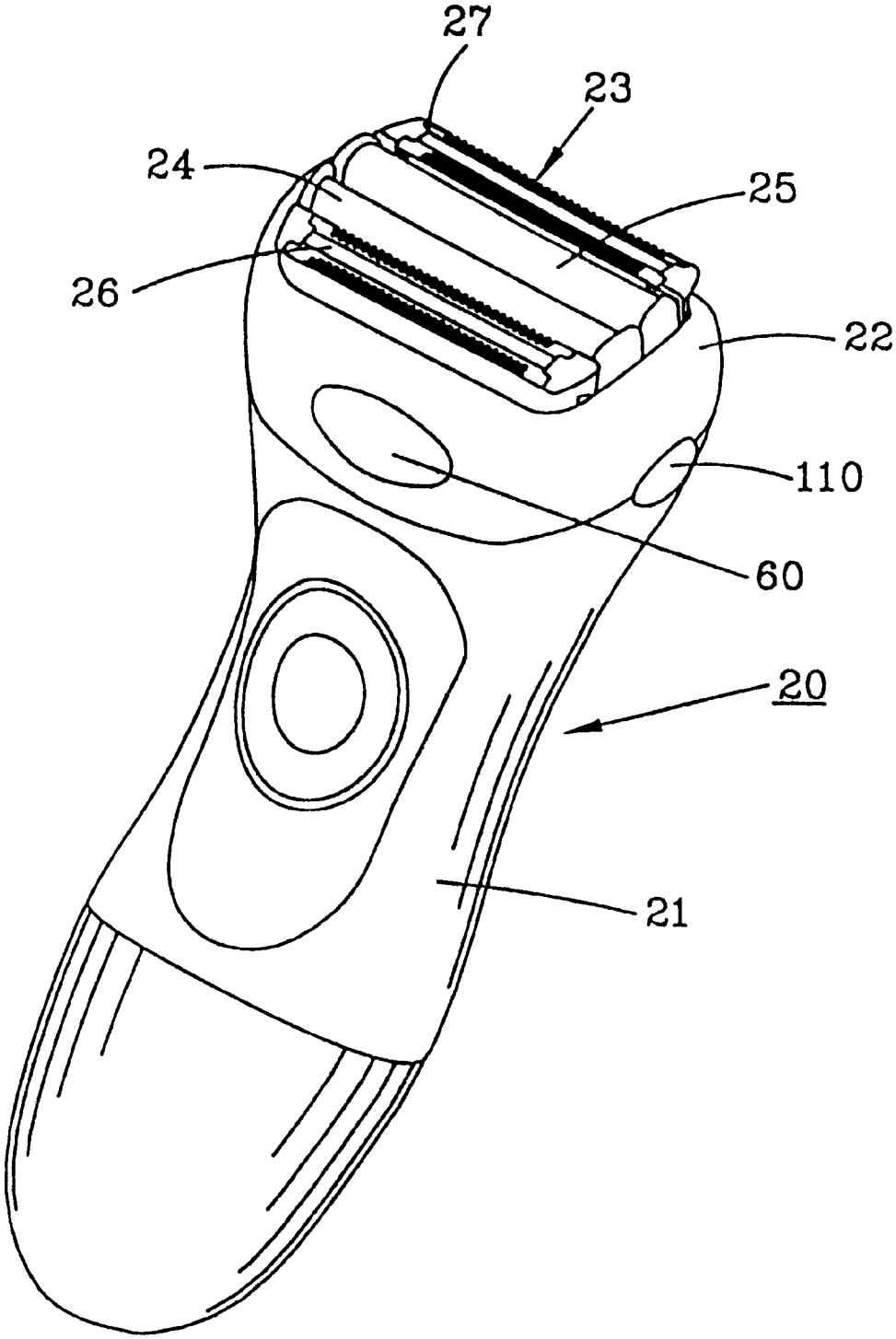
FIG. 1 is a perspective view of the preferred embodiment of the fully assembled shaver system of the present invention.
Figure 2A:
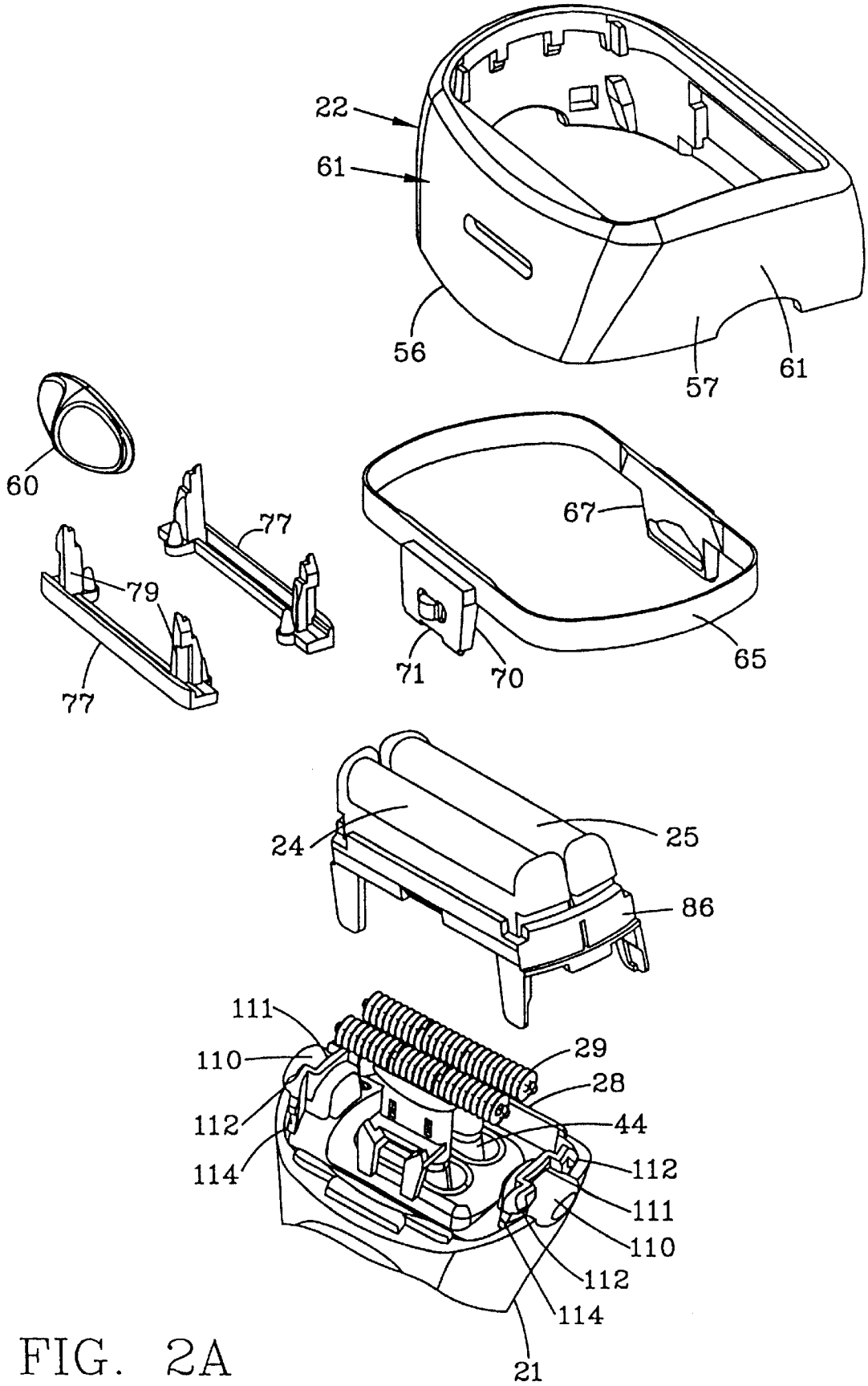
FIG. 2 is an exploded perspective view, partially broken away, of the shaver system of FIG. 1.
Figure 2B:
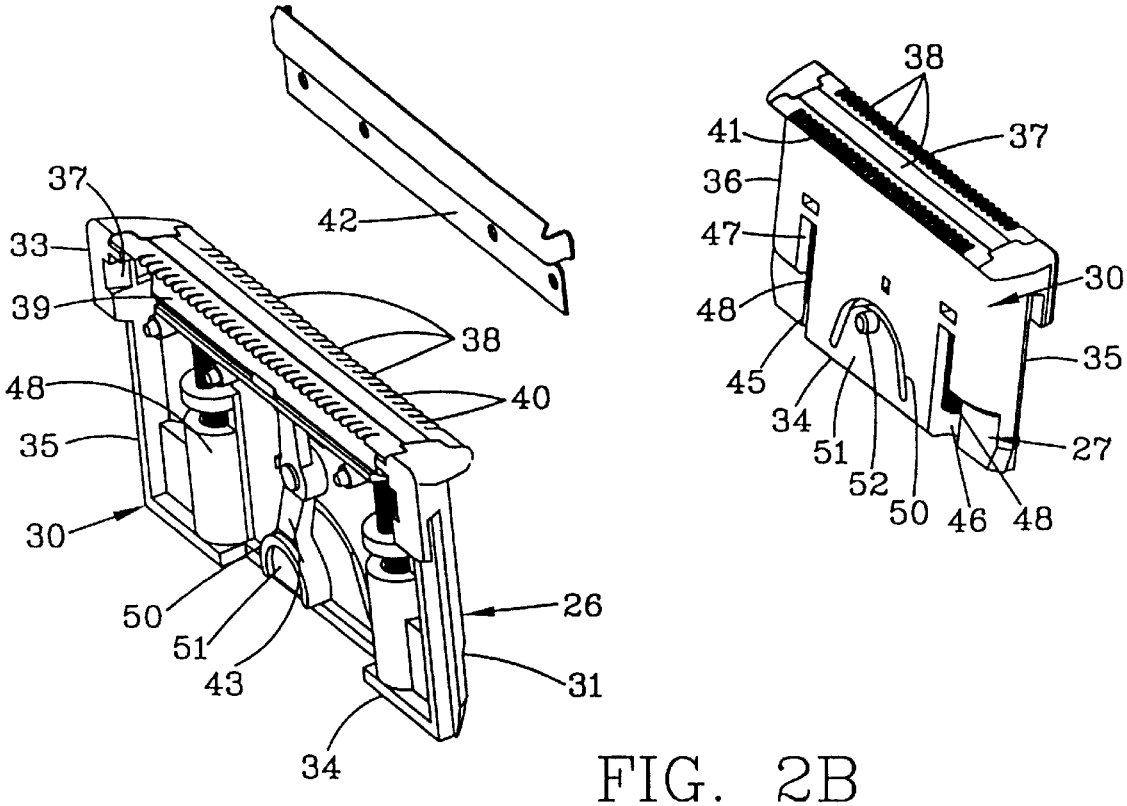
Figure 3:
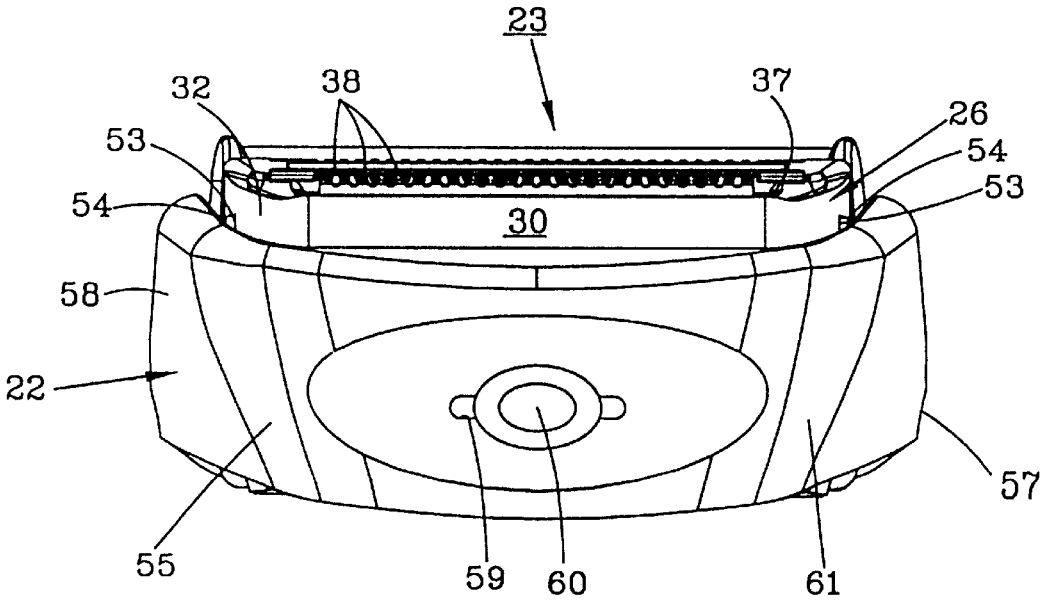
FIG. 3 is a front elevation view of the fully assembled guard/cover support base of the shaver system of the present invention depicted with the front trimmer in its raised or elevated position.
Figure 4:
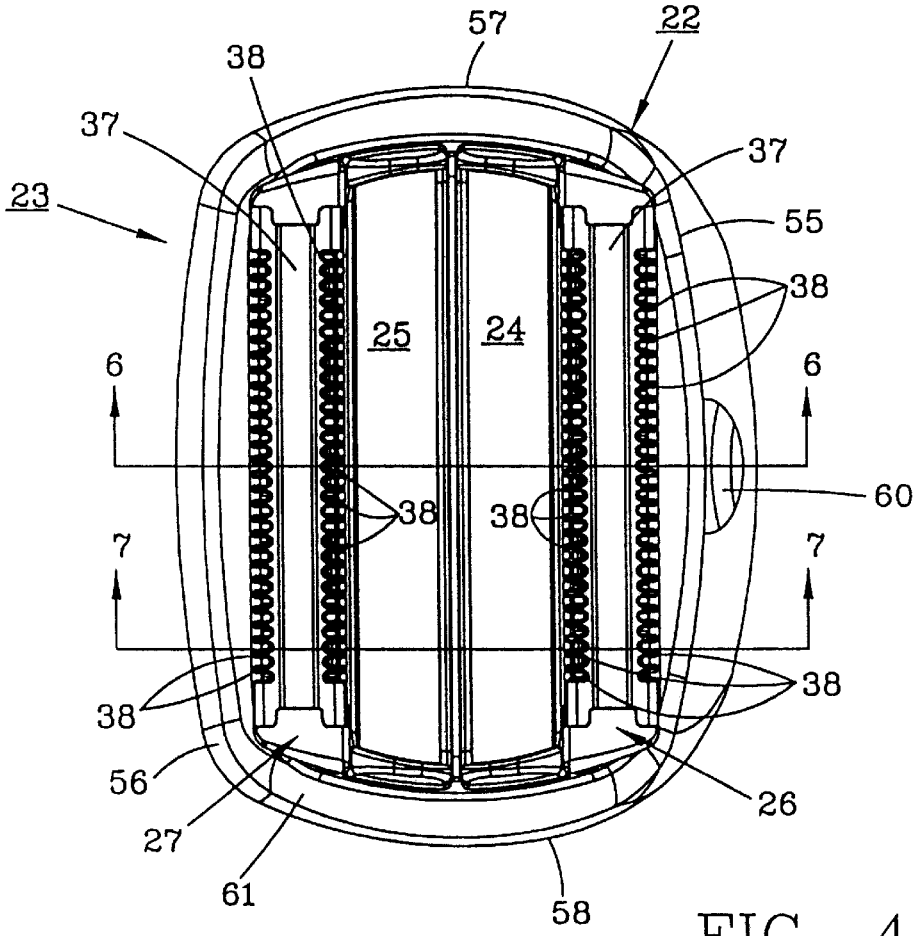
FIG. 4 is a top plan view of the guard/cover support base of FIG. 3.

In FIGS. 1 and 2, electric dry shaver system 20 is depicted incorporating housing 21 to which guard/cover support base 22 is removably mounted. In addition, hair cutting assembly 23 is incorporated in shaver system 20 for providing the desired cutting of both long hair and short hair.

In the preferred embodiment, as depicted, hair cutting assembly 23 incorporates apertured foils or mesh screens 24 and 25 which are mounted to guard/cover support base 22, and two trimmers 26 and 27 also mounted to guard/cover support base 22 in juxtaposed, spaced, cooperating relationship with apertured foils 24 and 25. In addition, in the conventional manner typically employed with electric dry shavers, housing 21 incorporates a motor (not shown) which drives movable shafts 44 which are interconnected to separate and independent cutting blade assemblies 28 and 29, which are maintained in mating, contacting, hair cutting interengagement with apertured foils 24 and 25.

By employing this construction, the activation of the motor causes the cutting blades to move in the desired, side-to-side, reciprocating manner, in contacting interengagement with the inside surface of one of the foil members. Preferably, guard/cover support base 22 is constructed for telescopic, overlying, locking interengagement with housing 21, in order to enable entry to the hair pocket for cleaning, as well as gaining access to the cutting blades 28 and 29 and foil members 24 and 25, whenever required. Although two cutting blades and two apertured foils are depicted, an alternate quantity can be employed without departing from the scope of this invention.

By referring to FIGS. 1–16, along with the following detailed discussion, the preferred construction and operation of trimmers 26 and 27 can best be understood. In the preferred embodiment, trimmers 26 and 27 each comprise a substantially flat plate 30 which incorporates inside surface 31, outside surface 32, top or upper edge 33, bottom edge 34, and side edges 35 and 36. In addition, fixed, stationary cutting blades 37 are mounted along top edge 33 of each plate 30 of trimmers 26 and 27, extending substantially the entire length thereof. In addition, each fixed cutting blade 37 comprises two rows of cutting teeth 38 which extend from plate 30 in opposite directions. In order to provide the desired long hair cutting action, each of the trimmers 26 and 27 also incorporates a movable cutting blade 39 mounted in cooperating interengagement with fixed cutting blades 37.

In this regard, each movable cutting blade 39 incorporates two rows of cutting teeth 40 and 41, each of which are aligned with one row of cutting teeth 38 of each fixed cutting blade 37. In addition, each movable cutting blade 39 is secured in place by retaining panel 42, which is mounted to inside surface 31 of plate 30. Preferably, panel 42 is positioned in overlying cooperating interengagement with movable cutting blade 39 in a manner which allows cutting blade 39 to move longitudinally along upper edge 33 of plate 30, thereby providing the desired cutting action.

In order to enable cutting blade 39 to be movable, arcuately pivotable cam arm 43 is mounted to inside surface 31 of plate 30 of trimmers 26 and 27, with an upper end thereof engaged with cutting blade 39 for controllably moving cutting blade 39 in the desired side-to-side manner. The opposed lower end of cam arm 43 is interengageable with drive means associated with shaft 44 and the drive motor of shaver system 20. By employing this construction, the activation of the drive motor in housing 21 causes cutting blades 28 and 29 to reciprocally move along apertured foils 24 and 25 while also causing cutting blades 39 to reciprocally move in a side-to side motion along fixed cutting blades 37, thereby providing the desired cutting action.

As is evident from the construction detailed above for cutting teeth 38 of fixed cutting blades 37, as well as cutting teeth 40 and 41 of movable cutting blades 39, these components are constructed with a plurality of cutting elements aligned in a juxtaposed, cooperating, overlying relationship with each other, forming a generally elongated, continuous strip of open cutting zones. In this way, longer hair fibers or shafts are capable of entering the cutting teeth 38 of blades 37 and cutting teeth 40 and 41 of blades 39 for being severed by the cutting action thereof.

In addition, in the preferred embodiment, trimmers 26 and 27 are constructed with each trimmer incorporating a pair of cutting elements formed along top edge 33 on both outside surface 32 and inside surface 31. If desired, a single cutting edge can be employed without departing from the scope of this invention. However, the use of two juxtaposed, spaced, parallel cutting edges formed on each trimmer is preferred for optimum performance and efficacy.

In order to provide operational flexibility and comfort to the user during the shaving operation, each of the trimmers 26 and 27 also incorporate a pair of elongated channels 45 and 46 formed in outer surface 32 of plate 30. Each channel 45 and 46 is opened at bottom edge 34 and terminates at its opposed upper end with a retaining boss 47.

In addition, spring means 48, preferably in the form of a conventional coil spring, is mounted in each channel 45 and 46, with one end of spring means 48 affixed to retaining boss 47 for securely affixing spring means 48 in channels 45 and 46, while still enabling the spring means to be operationally compressibly movable within channels 45 and 46. In this way, the desired vertical controlled biasing movability of trimmers 26 and 27, as further detailed below, is attained.

The preferred construction of each trimmer 26 and 27 is completed by forming arcuate slot 50 in plate 30 of each trimmer 26 and 27, with arcuate slot 50 extending into close proximity to lower edge 34. In this way, movable panel 51 is formed and is capable of being movably flexible relative to plate 30. In addition, pin means 52 is formed on movable panel 51 extending outwardly therefrom for cooperating interengagement with cam means, as is detailed below.

In order to provide controlled simultaneous movement of trimmers 26 and 27, as well as enable trimmers 26 and 27 to be movable into a plurality of alternate desired positions, shaver system 20 of the present invention incorporates a unique trimmer activation and position control system formed in guard/cover support base 22. By referring to FIGS. 5–11, along with the following detailed disclosure, the construction and operation of this unique trimmer activation and position control system can best be understood.

In the preferred embodiment, guard/cover support base 22 comprises a fully integrated, one-piece outer shell 61 (not shown in FIG. 5) incorporating a front panel 55, real panel 56, and side panels 57 and 58. Preferably, front panel 55, rear panel 56, and side panels 57 and 58 are all formed in an integral, one-piece construction forming shell 61. However, if desired, alternate constructions and configurations can be employed without departing from the scope of this invention. In addition, front panel 55 incorporates an elongated slot 59 within which activation switch or button 60 is mounted for movement within slot 59.

In order to provide the desired controlled movement of trimmers 26 and 27, guard/cover support base 22 incorporates a continuous, endless band 65 mounted on the interior surface of shell 61 of support base 22. In the preferred construction, a channel or groove 66 is formed on the inside walls of front panel 55, rear panel 56, and side panels 57 and 58 of shell 61 in the order to enable continuous, endless band 65 to be securely retained and longitudinally movable therein. In addition, activation switch or button 60 is affixed to band 65 for controlling the longitudinal movement thereof, whenever desired, within the limitations of elongated slot 59. Consequently, by moving activation switch or button 60 into alternate positions along slot 59, the entire endless band 65 is simultaneously moved therewith.

Figure 10:
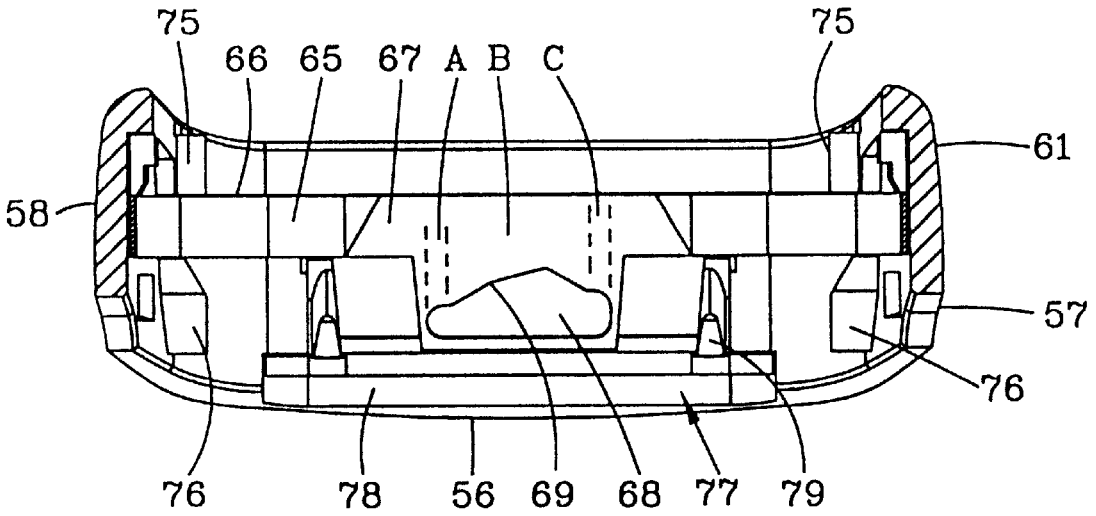
FIG. 10 is a cross-sectional rear view of the guard/cover support base of the present invention taken along line 10—10 of FIG. 9.

As best seen in FIG. 10, plate 67 is integrally affixed to band 65 substantially mid-way along the length of band 65 which extends along rear panel 56 of shell 61 of guard/cover support base 22. In addition, plate 67 incorporates recessed zone 68 which comprises cam surface 69. As fully detailed below, cam surface 69 controls the movement of trimmer 27.

Figure 5:
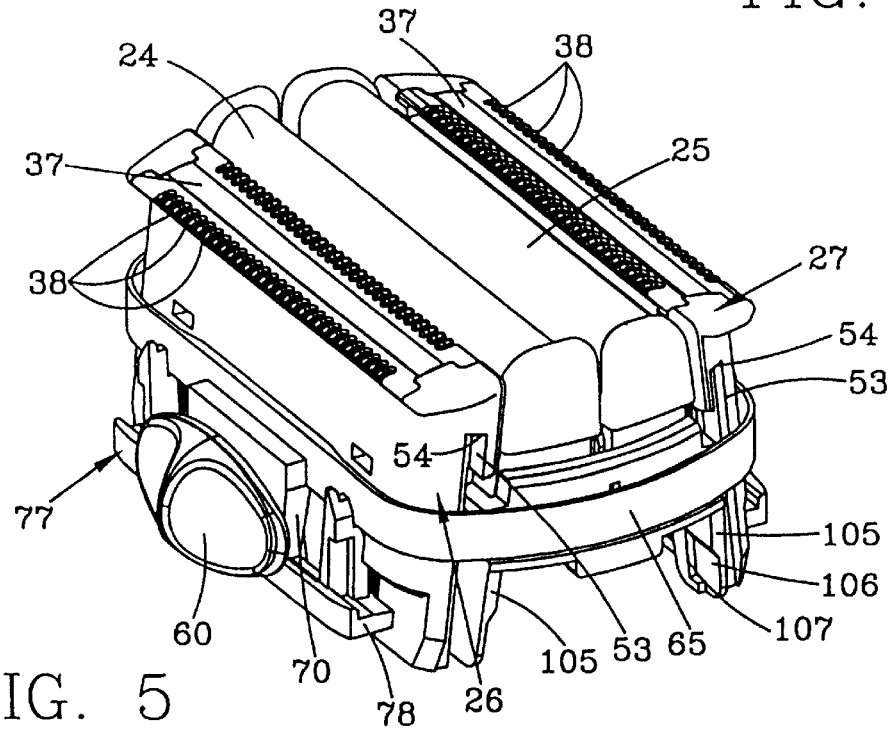
FIG. 5 is a perspective view of the fully assembled guard/cover support base of FIG. 3 with the outer housing thereof removed.
Figure 6:
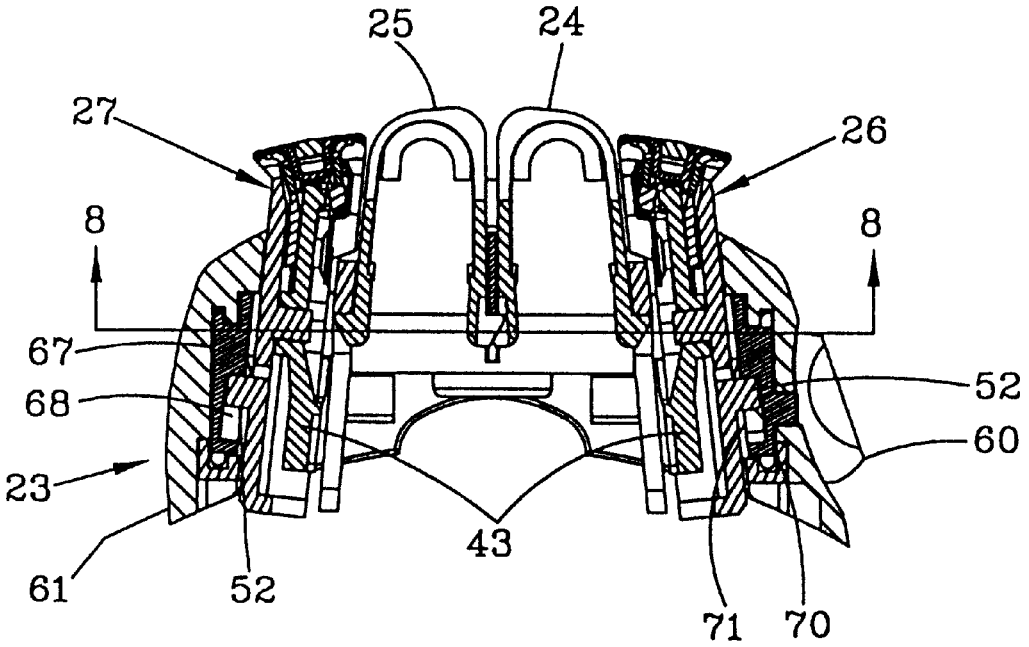
FIG. 6 is a cross-sectional side elevation view of the guard/cover support base of the present invention taken along line 6—6 of FIG. 4.
Figure 7:
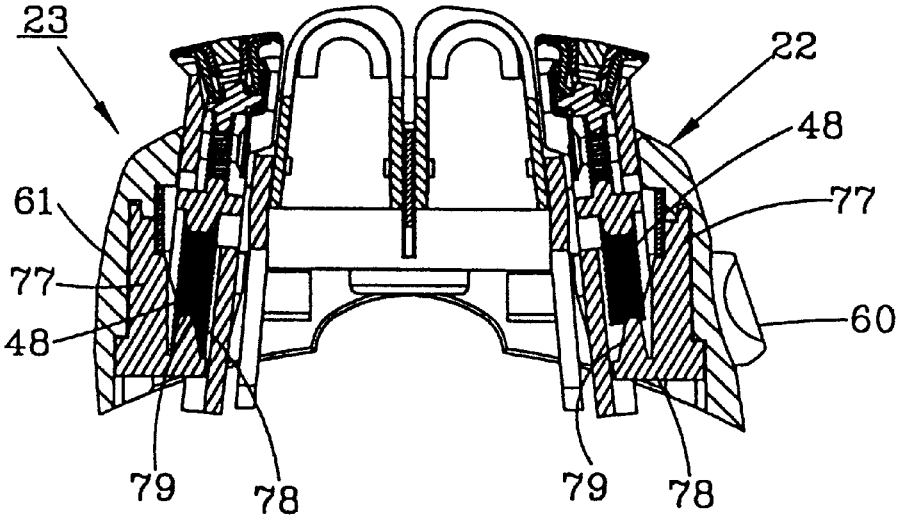
FIG. 7 is a cross-sectional side elevation view of the guard/cover support base of the present invention taken along line 7—7 of FIG. 4.
Figure 8:
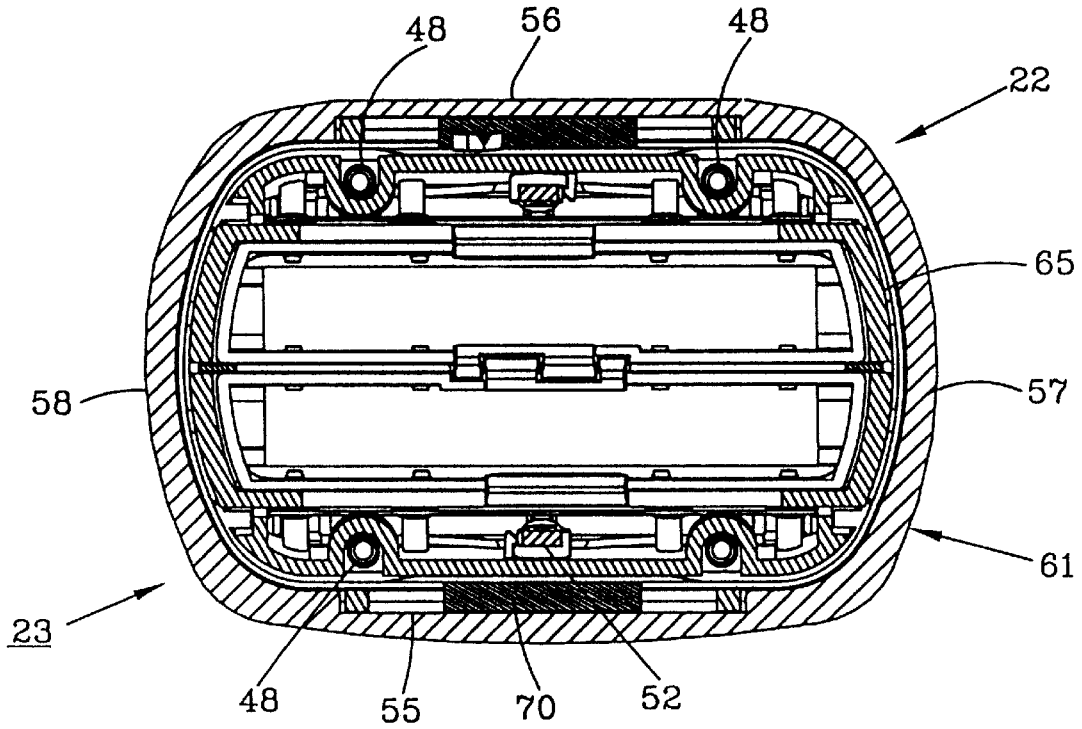
FIG. 8 is a bottom plan view of the guard/cover support base of the present invention taken along line 8—8 of FIG. 5.
Figure 9:
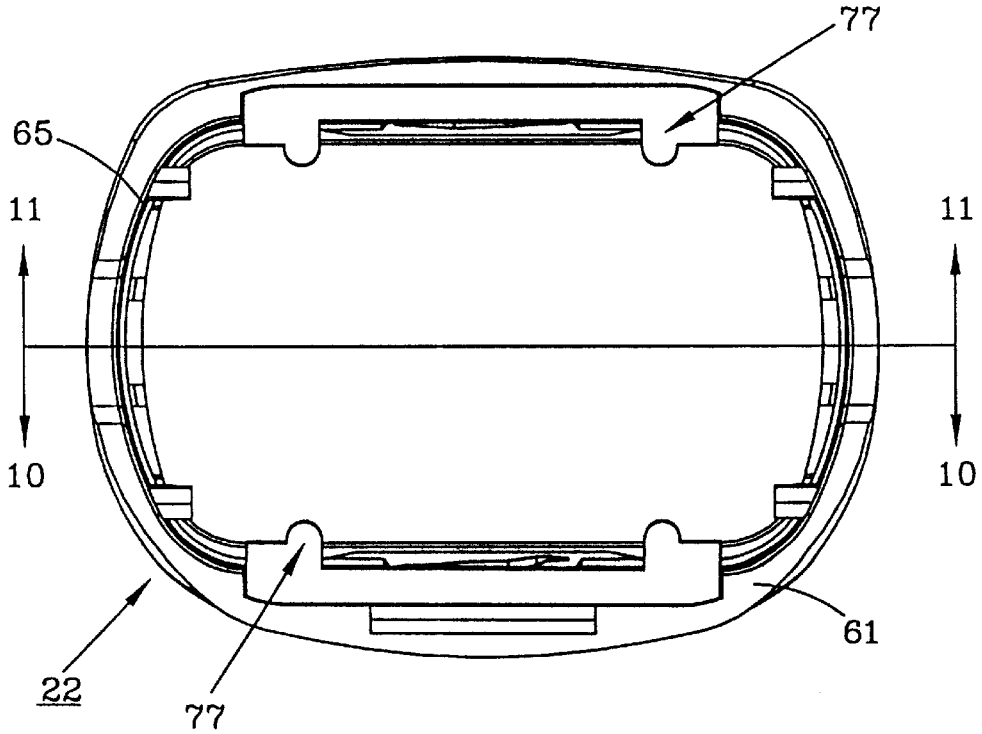
FIG. 9 is a bottom plan view of the outer housing of the disassembled guard/cover support base of the present invention.
Figure 11:
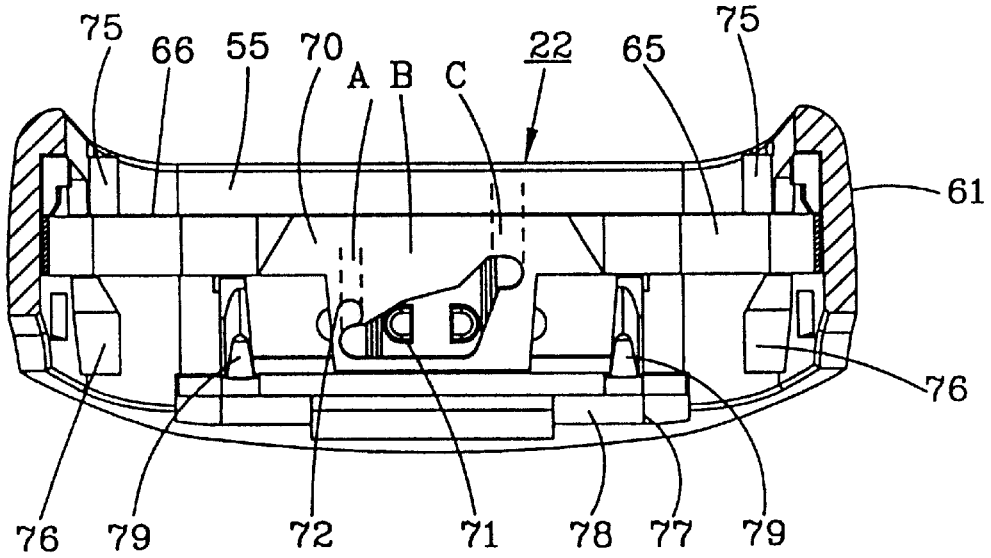
FIG. 11 is a cross-sectional front elevation view of the guard/cover support base of the present invention taken along line 11—11 of FIG. 9.

Similarly, as best seen in FIGS. 5 and 11, plate 70 is integrally affixed to band 65 substantially mid-way along the length of band 65 which extends along front panel 55 of shell 61 of guard/cover support base 22. As depicted, movement control button 60 is affixed to plate 70 in order to control the movement of band 65. In addition, plate 70 incorporates recess zone 71 which comprises cam surface 72. As detailed below, cam surface 72 controls movement of trimmer 26.

In the preferred construction, trimmer 26 is securely mounted to guard/cover support base 22 in a manner which assures that pin means 52 of plate 30 of trimmer 26 is securely retained within recessed zone 71, with cam surface 72 in controlling interengagement therewith. Similarly, trimmer 27 is securely mounted to guard/cover support base 22 in a manner which assures that pin means 52 of plate 30 of trimmer 27 is securely retained within recessed zone 68, with cam surface 69 in controlling interengagement therewith.

In this way, any movement of button/switch 60 causes endless band 65 to move, simultaneously causing plates 67 and 70 to move therewith. This movement also causes cam surfaces 69 and 72 to controllably move trimmers 27 and 26, due to the interengagement of pin means 52 with cam surfaces 69 and 72. As a result, by employing the desired configuration for cam surfaces 69 and 72, trimmers 26 and 27 are easily moved into the precisely desired positions.

In order to assure that trimmers 26 and 27 are securely mounted to guard/cover support base 22 in the precisely desired engaged position, side panel 57 and 58 of shell 61 of guard/cover support base 22 each comprise a pair of upper flanges 75 and lower flanges 76 positioned at opposed ends of each panel. Flanges 75 and 76 generally extend inwardly from side surfaces 57 and 58, directly adjacent the juncture between the side surfaces 57 and 58 with front panel 55 and rear panel 56. By employing this construction, plates 30 of trimmers 26 and 27 are securely mounted to guard/cover support base 22 in a manner which enables trimmers 26 and 27 to be vertically movable relative to support base 22.

In addition, in the preferred embodiment, guide channels or grooves 53 are formed in side edges 35 and 36 of plates 30 of trimmers 26 and 27. Furthermore, guide channels or grooves 53 are constructed for mating, cooperating engagement with upper flanges 75 and lower flanges 76 of support base 22. By employing this construction, guide channels/grooves 53 assist in controlling the vertical movement of trimmers 26 and 27 relative to support base 22, with flanges 75 and 76 slidingly retained therein. In addition, upper terminating end 54 of each of guide channels/grooves 53 provides a primary stop abutment for trimmers 26 and 27, limiting the downward vertical movement of trimmers 26 and 27 relative to support base 22.

In the preferred construction, guide channel-grooves 53 and flanges 75 and 76 are constructed to vertically move trimmers 26 and 27 in an arcuate path. In this way, the optimum position of the cutting edges of trimmers 26 and 27 relative to apertured foils 24 and 26 is obtained.

Preferably, support base 22 also incorporates a pair of brackets 77, with one bracket 77 mounted to front panel 55 and the second bracket 77 mounted to rear panel 56. In the preferred construction, each bracket 77 incorporates an inwardly extending flange 78 which provides another abutment stop for trimmers 26 and 27. In addition, upstanding posts 79 are formed along the outer edge of flange 78, and positioned for cooperating interengagement with spring means 48 of trimmers 26 and 27.

By employing this construction, trimmers 26 and 27 are each capable of being flexibly movable in a vertical direction with springs 48 imparting the desired biasing forces thereto. Due to the compression of the spring means 48 between posts 79 and retaining boss 47 formed in each spring retaining channel 45 and 46, trimmers 26 and 27 are continuously biased upwardly enabling trimmers 26 and 27 to be vertically flexible in use as the trimmers are moved over an individual's skin surface. In addition, flange 78 provides a secondary positive stop position beyond which trimmers 26 and 27 are incapable of traveling when moved downwardly.

As discussed above and shown in FIGS. 6 and 8, when trimmer 26 is mounted to support base 22, pin means 52 of plate 30 is securely retained in recessed zone 71 of plate 70 of endless band 65. Similarly, when trimmer 27 is mounted to support base 22, pin means 52 of plate 30 is securely retained in recessed zone 68 of plate 67 of band 65. In addition, since trimmers 26 and 27 are continuously biased in an upwards direction, pin means 52 of trimmer 27 is constantly urged into engagement with cam surface 69 of recessed zone 68, while pin means 52 of trimmer 26 is constantly urged into engagement with cam surface 72 of band 65.

By employing this construction, the precisely desired simultaneous movement of trimmers 26 and 27 is attained by merely moving switch/button 60. By designing the shape of cam surfaces 69 and 72 to provide the desired movement of trimmers 26 and 27, the longitudinal movement of switch/button 60 causes band 65 to move which enables plates 67 and 70 to move therewith. This movement causes the position of cam surfaces 69 and 72 in contact with pin means 52 to change. As a result, with trimmers 26 and 27 biased to maintain pin means 52 in contact with cam surfaces 69 and 72, the lateral movement of cam surfaces 69 and 72 relative to pin means 52 causes trimmers 26 and 27 to move vertically in direct response thereto.

As shown in FIGS. 10 and 11, cam surfaces 69 and 72 are constructed with three separate and independent position control zones "A", "B", and "C". Although zones "A", "B", and "C" may comprise a variety of configurations, the preferred embodiment employs zones "A" and "C" and specific, fixed positions, while enabling zone "B" to comprise a wider area which provide fine tuning adjustments by the user in order to obtain the most desirable, precise position.

By constructing zone "B" in as a longer, gently sloping cam surface, trimmers 26 and 27 are positioned directly adjacent the cutting surfaces of the apertured foils, while enabling the user to precisely position trimmers 26 and 27 to obtain optimum cutting results. If desired, positive positions can be established in zone "B" to provide specific locations in the zone. Alternatively, zone "B" may be constructed to allow a floating variation adjustment, as described above, to enable the user to establish the precisely desired position.

As is evident from the foregoing detailed discussion, when trimmers 26 and 27 are securely mounted to support base 22 in the desired manner, pin means 52 of plates 30 of trimmers 26 and 27 are retained within recess zones 68 and 71, with spring means 48 biasing pin means 52 into engagement with cam surfaces 69 and 72. As a result, whenever switch/button 60 is moved within slot 59, pin means 52 are forced to follow the contours of cam surfaces 69 and 72, causing trimmers 26 and 27 to be controllably moved into the three separate and independent positions represented by zones "A", "B", and "C". By properly configuring and designing cam surfaces 69 and 72, trimmers 26 and 27 are controllably positioned in the precisely desired locations.

Figure 12:
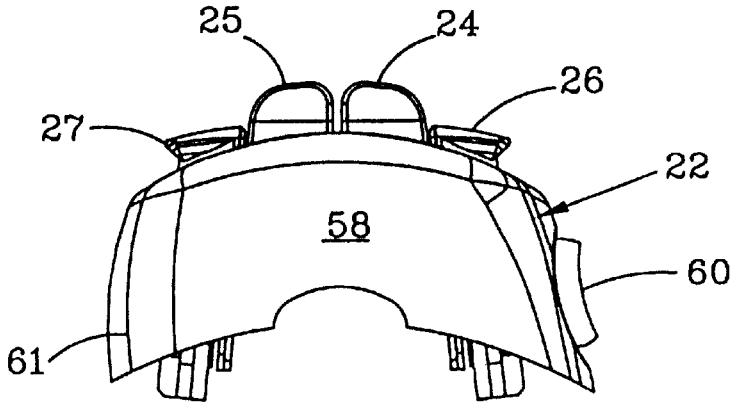
FIG. 12 is a side elevation view of the fully assembled guard/cover support base of the present invention showing the trimmers in their lowered position.

In the preferred construction of cam surface 69, zone "A" maintains trimmer 27 in a lowered position, wherein the cutting-edges thereof are below the arcuately curved, cutting surfaces of aperture foils or mesh screens 24 and 25. Similarly, zone "A" of cam surface 72 places trimmer 26 in a lowered position with the cutting-edge thereof placed below the arcuately curve cutting surfaces of apertured foils/mesh screens 24 and 25. As a result, as shown in FIG. 12, when zone "A" is selected by the user, both trimmers 26 and 27 are in substantially identical positions, enabling the user to employ apertured foils/mesh screens 24 and 25, while trimmers 26 and 27 are in a generally inoperative position. If desired, the cutting action of the trimmers can be stopped when trimmers 26 and/or 27 are in position "A". Alternatively, cutting can continue if believed to be desirable.

In addition, in this position, spring means 48 are maintained in a fully compressed position, with flanges 75 abutting upper ends 54 of the guide channels/grooves 53 of plates 30. As is evident from the foregoing detailed discussion, this position is easily attained, whenever desired by the user, by merely moving switch/button 60 in slot 59 so as to cause pin means 52 of trimmers 26 and 27 to be advanced into zone "A" of cam surfaces 69 and 72.

Figure 13:
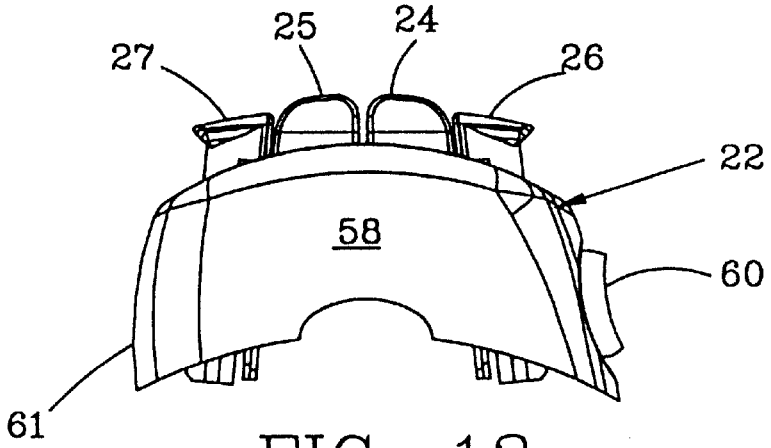
FIG. 13 is a side elevation view of the fully assembled guard/cover support base of the present invention depicting the trimmers in their operative cutting, intercept position.

In the second preferred position, trimmers 26 and 27 are positioned with the cutting edges thereof directly adjacent the top, arcuately curved, cutting surfaces of apertured foils or mesh screens 24 and 25. In this position, trimmers 26 and 27 are capable of cutting longer hair fibers, simultaneously with shorter hair fibers being cut by apertured foils 24 and 25. In order to attain this position, which is shown in FIG. 13, zone "B" of cam surfaces 69 and 72 are constructed for maintaining pin means 52 of trimmers 26 and 27 in the precisely desired location whereby trimmers 26 and 27 are maintained in this desired, hair cutting, intercept position.

When in this position, both trimmers 26 and 27 are capable of being used simultaneously with apertured foils/mesh screens 24 and 25, with the cutting teeth of the trimmers aligned with the arcuately curved, cutting surface of apertured foil/mesh screens 24 and 25. As a result, by placing button/switch 60 in the desired location for causing band 65 to move cam surfaces 69 and 72 into the position wherein zone "B" controls of the position of pin means 52, trimmers 26 and 27 are both positioned with the cutting-edge thereof aligned with apertured foils/mesh screens 24 and 25, enabling both long hair and short hair to be cut simultaneously as hair cutting assembly 23 is moved over the skin surface to be shaved. As detailed above, this position is preferably constructed to allow trimmers 26 and/or 27 to be adjustable, variable, or floating relative to the apertured foils in order to enhance the cutting action for each user.

Figure 14:
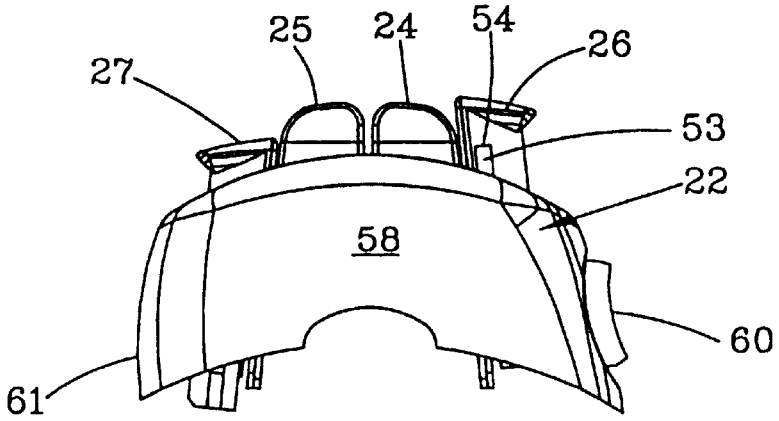
FIG. 14 is a side elevation view of the fully assembled guard/cover support base of the present invention depicting one trimmer in its raised, elevated position.

In the preferred embodiment, zone "C" of cam surfaces 69 is constructed for causing pin means 52 of trimmer 27 to move trimmer 27 into a lowered position, generally similar to the position provided in zone "A". In addition, zone "C" of cam surface 72 is constructed for positioning trimmer 26 in a raised location with the cutting teeth thereof maintained in a plane above apertured foils/mesh screens 24 and 25. This position is depicted in FIG. 14, and enables trimmer 26 to be separately employed, while trimmer 27 is in a generally lowered, inactive position.

By employing the construction detailed herein, these alternate desirable positions are attained for trimmers 26 and 27 in a quickly and easily employed system. In addition, any desired alternate position or combination of positions can be realized by merely forming cam surfaces 69 and 72 in the required manner.

Another feature incorporated into the dry shaver system of the present invention relates to the holding and mounting construction of apertured foils or mesh screens 24 and 25. By referring to FIGS. 2, 5, 15, and 16, along with the following a detailed disclosure, this unique construction can best be understood.

In the preferred embodiment of the present invention, foil holding assembly 82 is employed comprising removable carrier 86 and foil holding frames 84 and 85. In the preferred construction, apertured foil 24 is securely affixed to foil holding frames 84, while aperture foil 25 is securely affixed to foil holding frame 85.

Figure 16:
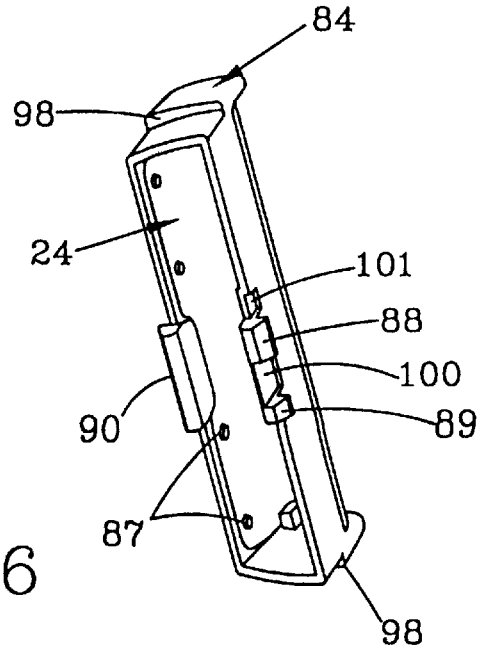
FIG. 16 is a bottom perspective view of one apertured foil holding frame.

As shown in FIG. 16, the terminating edge of apertured foil 24 is preferably secured to holding frames 84 by employing staking means 87. In this way, the precisely desired arc of curvature is established for apertured foil 24 and this arc of curvature is maintained during the installation and use of apertured foil 24. Although not specifically depicted, apertured foil 25 is securely affixed to holding frame 85 in substantially an identical manner with apertured foil 25 comprising a substantially identical arc of curvature.

By employing this construction, the preferred embodiment of the present invention provides apertured foils 24 and 25 with an arc of curvature which range between about 160° and 170°. In most prior art apertured foil constructions, the arc of curvature of the foil is substantially less. However, by employing the present invention with its increased arc of curvature, a substantially increased contact zone is established between apertured foils 24 and 25 and cutting blade assemblies 28 and 29. As a result, increased cutting capabilities are provided, producing a more efficient shaver operation.

Figure 15:
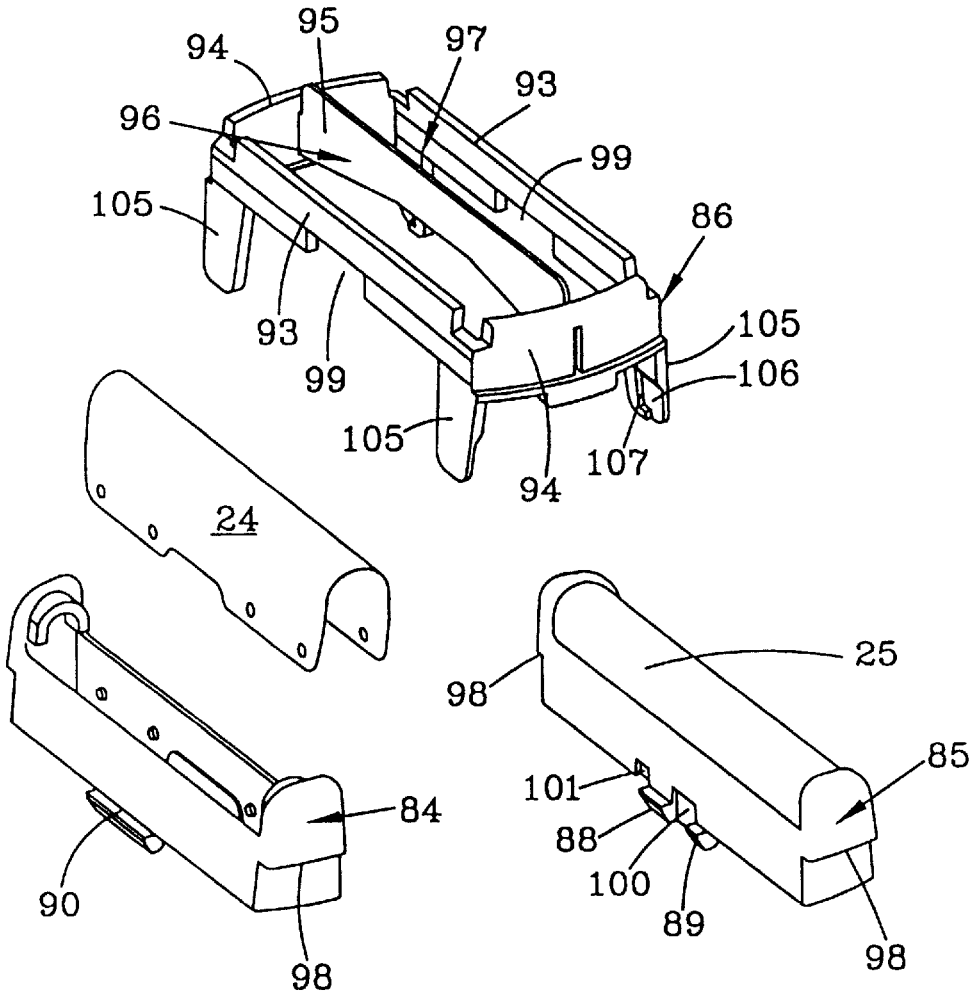
FIG. 15 is an exploded perspective view of the apertured foil holding frames and their associated removable carrier.

In the preferred construction of the present invention, foil holding frames 84 and 85 are constructed to be telescopically inserted and engaged with removable carrier 86, in a manner which allows holding frames 84 and 85 to be vertically movable relative to carrier 86. In addition, foil holding frames 84 and 85 comprise uniquely constructed locking fingers 88, 89, and 90, formed along the bottom edge thereof. As shown in FIGS. 15 and 16, a pair of locking fingers 88 and 89 are formed along one bottom edge of each holding frame 84 and 85, positioned in juxtaposed, spaced, cooperating relationship with each other, while locking finger 90 is formed on the opposed bottom edge of each holding frame 84 and 85.

Preferably, locking fingers 88, 89, and 90 are formed on each holding frame 84 and 85, substantially midway along the length of the bottom edge thereof. In this way, as further detailed below, foil holding frames 84 and 85 are securely retained by carrier 86, while also being capable of both vertical movement relative to frame 86 as well as arcuate pivoting or rocking movement relative thereto, as shown in FIG. 5. In this way, substantially enhanced and improved contact between apertured foils 24 and 25 and cutting blade assemblies 28 and 29 are obtained during this operation, providing substantially improved cutting efficacy.

In the preferred construction, removable carrier 86 is designed for being matingly interengaged and lockingly secured with shell 61 as an integral component of guard/cover support base 22. In the preferred embodiment, carrier 86 comprises a generally rectangular shaped frame structure defined by longitudinally extending rails 93 and interconnecting side sections 94.

In addition, a support panel 95 is mounted to carrier 86, extending between side sections 94, substantially at their midpoint. Preferably, panel 95 is mounted between rail 93 in juxtaposed, spaced, parallel relationship therewith. By employing this construction, two frame receiving zones 96 and 97 are formed for receiving and securely retaining holding frames 84 and 85 in carrier 86 in a manner which provides the desired vertical and arcuate movement detailed herein.

In the preferred construction, foil holding frames 84 and 85 each comprise a ledge 98 formed on each side surface thereof, with ledges 98 positioned for cooperative association with locking fingers 88, 89, and 90, to define the vertical movement of holding frames 84 and 85 relative to carrier 86. When holding frame 84 is securely mounted in frame receiving zone 96 of carrier 86, locking finger 90 engages the lower surface of rail 93. In the preferred embodiment, notch 99 is formed in the lower surface of rail 93, with notch 99 being dimensioned for receiving and retaining locking finger 90 therein. In addition, locking fingers 88 and 89 of holding frame 84 are securely retained along the bottom edge of panel 95.

By employing this construction, foil holding frame 84 is securely retained in carrier 86 in a manner which assures and provides the desired vertical movement and arcuate pivotability. In this regard, the vertical movability of holding frame 84 is established by the vertical distance of between ledge 98 and locking fingers 88, 89 and 90. By properly dimensioning these components, holding frame 84 is capable of being vertically movable relative to carrier 86 through the precisely desired vertical distance.

By positioning locking fingers 88, 89 and 90 substantially midway along the bottom edges of holding frame 84, holding frames 84, when mounted in carrier 86, is not restricted along its side edges, other than by ledge 98. As a result, holding frame 84 is able to arcuately pivot about an axis substantially perpendicular to the longitudinal axis of foil 24. In this way, the desired cooperative pivoting movement of holding frame 84 with cutting blade assembly 28 is provided as shaver 20 is advanced over the user's skin surface.

Using a virtually identical construction, holding frame 85 is securely mounted in frame receiving zone 97 of carrier 86, providing the identical vertical movability and arcuate pivotability relative thereto. In this regard, in order to assure the free and independent movement of each foil holding frame 84 and 85 relative to each other, while enabling both holding frames to be securely retained along the bottom edge of the panel 95, holding frames 84 and 85 each incorporate a notch or recess 100 formed between the locking fingers 88 and 89, as well as a second notch or recess 101 formed on the opposite side of locking finger 88.

Notch/recess 100 of each holding frame is dimensioned for receiving locking finger 88 of the adjacent holding frame. Similarly, notch/recess 101 of each holding frame is dimensioned for receiving locking finger 89 of the opposed holding frame. In this way, locking fingers 88 and 89 of each holding frame 84 and 85 are capable of mating interengaged relationship along the bottom edge of panel 95, securely retained on panel 95 while being capable of the desired vertical movement and arcuate pivotability.

In the preferred embodiment, removable carrier 86 is constructed for forming an integral component of hair cutting assembly 23, while being mounted between trimmers 26 and 27 in cooperating relationship therewith. Preferably, carrier 86 is mounted in co-operative engagement with shell 61 of guard/cover support base 22, providing the desired fully integrated hair cutting assembly 23.

In order to enhance the operation and usability of the present invention, carrier 86 is constructed to provide two alternate removal modes. In this regard, in one mode, carrier 86 is constructed for being removed in its entirety simultaneously with the removal of guard/cover support base 22. Alternatively, in an alternate mode, carrier 86 is constructed to be retained in engagement with cutting blade assemblies 28 and 29 while the remainder of guard/cover support base 22 is removed.

In order to attain this desirable dual mode removal of carrier 86, the rectangular frame forming carrier 86 incorporates substantially flat posts 105 formed at each juncture of rails 93 with sides 94, with posts 105 extending substantially vertically downwardly therefrom. In addition, each post 105 incorporates recessed area 106 which is a defined by outwardly extending, C-shaped ledge 107.

In completing the construction of shaver system 20 of the present invention and providing the desired dual release mode for carrier 86, housing 21 of shaver system 20 incorporates release buttons 110 formed on opposed sides thereof, positioned for cooperating engagement and release of guard/cover support base 22. In this regard, each release button 110 is longitudinally movable relative to housing 21 and incorporates a locking plate 111 attached to button 110 for movement therewith. In addition, each locking plate 111 incorporates a first pair of locking tabs or fingers 112 which extend in a first direction and a second pair of locking tabs or fingers 114 which extend in a second direction.

Locking tabs/fingers 112 are constructed in a generally conventional manner, positioned for cooperating locking and release engagement with shell 61 of support base 22. In this conventional construction, shell 61 incorporates receiving zones for locking tabs/fingers 112, and each plate 111 and button 110 are spring biased to maintain locked interengagement of tabs/fingers 112 with shell 61 of base 22.

In this way, when support base 22 is mounted to housing 21, support base 22 is normally maintained in locked interengagment therewith. However, whenever removal of base 22 from housing 21 is desired, buttons 110 are longitudinally pressed inwardly, releasing locking tabs/fingers 112 from engagement in the receiving zone of shell 61, enabling support base 22 to be removed from housing 21.

In addition, each locking tab/finger 114 formed on locking plate 111 is constructed and positioned for providing sliding interengagment with recess area 106 of post 105. In this regard, when buttons 110 are pressed inwardly to the full extent possible, locking tabs 112 are removed from engagement in receiving zones of shell 61, enabling support base 22 to be removed from housing 21, while locking tabs/fingers 114 enter recess areas 106 of posts 105 as well as the zone of recess area 106 surrounded by C-shaped ledge 107. As a result, although shell 61 of support base 22 is released, carrier 86 is retained in engagement with cutting blade assemblies 28 and 29 of housing 21, since the engagement of locking tabs/fingers 114 with C-shaped ledge 107 prevents carrier 86 from being removed from housing 21.

If the user desires to remove guard/cover support base 22 from housing 21 along with carrier 86, buttons 110 are partially pressed inwardly a sufficient distance to enable locking tabs/fingers 112 to remove from the receiving zones of shell 61. However, when buttons 110 are only partially pressed inwardly, locking tabs/fingers 114 enter recess zones 106 of posts 105, while not entering into engagement with C-shaped ledge 107. As a result, carrier 86 is free to be removed from housing 21 along with guard/cover support base 22.

By employing this construction, a dual mode of removability is provided for carrier 86, along with apertured foils 24 and 25 retained in carrier 86. As a result, the user is able to enjoy the added benefits provided by this dual mode of operation.

As is evident from the foregoing detailed disclosure, the present invention overcomes all of the difficulties previously encountered with prior art dry shaver products. In addition, numerous variations of the present invention can be made without departing from the scope of this invention. Consequently, these alternate embodiments are intended to be within the scope of the present invention.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. An electric dry shaver for providing improved cutting of long hair and short hair comprising:

A. a housing;

B. at least one arcuately curved, apertured foil member removably mounted to the housing;

C. at least one cutting blade assembly securely mounted with the housing for reciprocating movement relative thereto and cooperatively associated with said arcuately curved foil member for contacting engagement with one surface of said foil member; and D. a support base removably mounted to the housing incorporating a first panel and a second panel in juxtaposed, spaced, facing relationship with each other and comprising:

a. at least one trimmer mounted to the first panel of the support base, positioned for cooperative association with the apertured foil and adjustably movable relative to said support base and said apertured foil;

b. an elongated band 1. mounted to the support base, 2. constructed for sliding movement relative to the support base, and 3. incorporating trimmer control means mounted to the second panel of the support base and engaged with the trimmer for causing said trimmer to move relative to the support base in response to movement of said band;

whereby an electric dry shaver is attained wherein the trimmer is easily adjustably movable relative to the apertured foil.

2. An electric dry shaver for providing improved cutting of long hair and short hair comprising:

A. a housing;

B. at least one arcuately curved, apertured foil member removably mounted to the housing;

C. at least one cutting blade assembly securely mounted with the housing for reciprocating movement relative thereto and cooperatively associated with said arcuately curved foil member for contacting engagement with one surface of said foil member; and D. a support base removably mounted to the housing and comprising:

a. two separate and independent trimmers, each of which are mounted to the support base and adjustably movable relative thereto and are positioned for cooperative association with the apertured foil and adjustably movable relative to said support base and said apertured foil;

b. an elongated band 1. mounted to the support base, 2. constructed for sliding movement relative to the support base, and 3. incorporating trimmer control means engaged with said two trimmers for causing said trimmers to move relative to the support base in response to movement of said band;

whereby an electric dry shaver is attained wherein the trimmers are easily adjustably movable relative to the apertured foil.

3. The electric dry shaver defined in claim 2, wherein said elongated band is further defined as being endless, mounted in peripheral surrounding engagement with the support base and incorporating a first and a second separate and independent trimmer control means, each of which are separately engaged with one of said trimmers for enabling said trimmers to be simultaneously moved relative to the support base in response to movement of said band.

4. The electric dry shaver defined in claim 3, wherein each of said trimmer control means is further defined as incorporating a cam surface and each of said trimmers is further defined as comprising a cam follower controllably engaged with the cain surface of the trimmer control means associated therewith, whereby movement of said control means causes movement of the trimmer engaged therewith.

5. The electric dry shaver defined in claim 4, wherein the cam surface of each trimmer control means is further defined as comprising at least three separate and independent zones, each defining a separate position for the trimmer associated therewith.

6. The electric dry shaver defined in claim 5, wherein said support base is further defined as comprising a shell having an outer surface and an inner surface, and the endless band is defined as being mounted along the inner surface of said shell, controllably movable by switch means affixed to the band.

7. The electric dry shaver defined and claim 6, wherein said shell is further defined as comprising an elongated slot and said switch means is further defined as extending from the outer surface of the shell through said slot to said band for enabling movement of the band to be achievable from the outer surface of said shell, within the limitations defined by said elongated slot.

8. The electric dry shaver defined in claim 7, wherein the movement of the switch means simultaneously causes both trimmers to move into one of the three alternate positions and be maintained in said position until further movement is desired.

9. The electric dry shaver defined in claim 8, wherein the position of the cutting blades of each trimmer is selected from the group consisting of substantially parallel with the apertured foil, below the apertured foil, and above the apertured foil.

10. The electric dry shaver defined in claim 2, wherein each of said trimmers is further defined as comprising a support panel incorporating cutting blades mounted along a top surface thereof, with said support panel being movably mounted to the support base independent of said trimmer control means.

11. The electric dry shaver defined in claim 10, wherein said support panel of each of said trimmers is further defined as comprising spring means mounted thereto for biasing said support panel into engagement with the cam surface of the control means, while also enabling vertical movability of said support panel relative to the support base independent of said cam surface.

12. The electric dry shaver defined in claim 9, wherein each of said trimmers is further defined as being removable from the support base if desired by the user.

13. The electric dry shaver defined in claim 12, wherein said support base comprises a substantially rectangular shaped housing having an outer surface and an inner surface formed by co-parallel members, said inner surface incorporating a plurality of fins formed on opposed walls of the inner surface, said fins extending inwardly, and each of said panels forming the trimmers comprising slots formed therein constructed for receiving and being slidingly engaged with the fins, thereby controlling and guiding the vertical movement of the trimmers relative to the base.

14. The electric dry shaver defined in claim 13, wherein the construction of the fins of the housing and the slots of the panel provide both vertical and arcuate movement of said panel relative to the housing for positioning each trimmer in a precisely desired location relative to the apertured foils.

15. The electric dry shaver defined in claim 14, wherein said control means further comprises a recess zone formed in the band, with said recess zone comprising a cam surface for controllably moving the trimmer in response to movement of said recess zone, and said panel forming the trimmer incorporates an outwardly extending cam following pin engagingly mounted within said recess zone for being controllably moved by said cam surface.

16. The electric dry shaver defined in claim 15, wherein said cam following pin is mounted to a movable portion of said panel for enabling the removal of the panel and trimmer from the support base.

17. An electric dry shaver for providing improved cutting of long hair and short hair comprising:

A. a housing;

B. at least two cutting blade assemblies each being securely mounted with the housing for reciprocating movement relative thereto and cooperatively associated with a separate and independent arcuately curved foil member for contacting engagement with one surface of said foil member; and C. a support base removably mounted to the housing and comprising:

a. a carrier, 1. removably mounted to the support base, and 2. at least two arcuately curved apertured foil members, each being securely mounted to a separate and independent holding frame retained in said carrier, b. at least one trimmer positioned for cooperative association with the apertured foil and adjustably movable relative to said support base and said apertured foil; and c. an elongated band 1. mounted to the support base, 2. constructed for sliding movement relative to the support base, and 3. incorporating trimmer control means engaged with the trimmer for causing said trimmer to move relative to the support base in response to movement of said band;

whereby an electric dry shaver is attained wherein the trimmer is easily adjustably movable relative to the apertured foil.

18. The electric dry shaver defined in claim 17, wherein each of said frame members are removably mounted to the carrier and securely retains the apertured foil mounted thereto with an arc of curvature ranging between about 170° and 170°.

19. The electric dry shaver defined in claim 18, wherein each of said frame members comprises a rectangular-shaped base to which the terminating ends of the apertured foil are securely affixed.

20. The electric dry shaver defined in claim 19, wherein each of said frame members incorporate latch means centrally positioned on the bottom edge of the base constructed for lockingly engaging the frame member with the carrier, and an outwardly extending ledge formed on the frame members and vertically spaced away from the latch means, thereby enabling the frame member to arcuately pivot and move vertically relative to the carrier.

21. The electric dry shaver defined in claim 17, wherein said carrier is further defined as comprising a generally rectangular shape formed by two juxtaposed, spaced, parallel, facing rail members and two juxtaposed, spaced, facing, parallel sides interconnecting the rail members to each other, and post members formed at each juncture between a rail member and a side and extending substantially perpendicularly therefrom.

22. The electric dry shaver defined in claim 21, wherein said housing incorporates release means movably mounted thereto which incorporate a release plate cooperatively associated with the support base, providing a first release position wherein the Support base is removed from the housing in its entirety and a second release position wherein the carrier and foil holding frame are retained on the housing while the remainder of the support base is removed.

23. The electric dry shaver defined in claim 22, wherein each of said posts of the carrier comprise a flange engaging zone and said release plate incorporates a plurality of cooperating flanges positioned for being engaged in the flange engaging zone of each post when said plate is in its second position, while being spaced away from the flange engaging zone when in its first position.

* * * * *